US008616167B2

(12) United States Patent
Nendel

(10) Patent No.: US 8,616,167 B2
(45) Date of Patent: Dec. 31, 2013

(54) ACTUATOR DEVICE FOR ADJUSTING A SLIDING CAM SYSTEM

(75) Inventor: Andreas Nendel, Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/701,900

(22) PCT Filed: Apr. 20, 2011

(86) PCT No.: PCT/EP2011/056295
§ 371 (c)(1),
(2), (4) Date: Dec. 28, 2012

(87) PCT Pub. No.: WO2011/157466
PCT Pub. Date: Dec. 22, 2011

(65) Prior Publication Data

US 2013/0098318 A1 Apr. 25, 2013

(30) Foreign Application Priority Data

Jun. 16, 2010 (DE) ..... 10 2010 024 030

(51) Int. Cl.
*F01L 1/34* (2006.01)

(52) U.S. Cl.
USPC ..... 123/90.18; 123/90.11

(58) Field of Classification Search
USPC ..... 123/90.1, 90.15, 90.17, 90.18, 90.6, 123/90.11; 335/229
See application file for complete search history.

(56) References Cited

U.S. PATENT DOCUMENTS

| | | | | |
|---|---|---|---|---|
| 5,806,478 | A | 9/1998 | Oberg | |
| 6,967,550 | B2 * | 11/2005 | Elendt et al. | 335/229 |
| 8,365,692 | B2 * | 2/2013 | Schoeneberg et al. | 123/90.18 |
| 2010/0126447 | A1 | 5/2010 | Talan et al. | |
| 2010/0192885 | A1 * | 8/2010 | Golz et al. | 123/90.17 |

FOREIGN PATENT DOCUMENTS

| | | |
|---|---|---|
| DE | 20114466 | 2/2002 |
| DE | 102007052252 | 5/2009 |
| DE | 102007054978 | 5/2009 |
| DE | 102008024086 | 11/2009 |
| DE | 102008060169 | 6/2010 |
| DE | 102007010419 | 4/2011 |
| DE | 10240774 | 5/2011 |
| WO | 2010091780 | 8/2010 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

Actuator device of a sliding cam system, having at least one sliding cam (2) and having an engagement pin (9) which protrudes out of a housing (6), wherein the housing (6) can be fastened to a component of a cylinder head or to the cylinder head of an internal combustion engine, and it is possible for contact to be made with the engagement pin (9) by at least one groove (3) of the sliding cam system, which groove (3) has at least one ejection ramp (4), and wherein, within the housing (6), the engagement pin (9) has a permanent holding magnet (11) and, adjoining it, is a controlling stationary coil core (9) which can be magnetized by an electric coil (7), and the engagement pin (9) is spring-loaded in the direction of the sliding cam (2), and wherein an actuating device is installed at least at that end region of the engagement pin (9) which faces the sliding cam (2), which actuating device is active in the region of the run-out of the ejection ramp (4) to the high circle (18) and generates an additional force on the engagement pin (9) in the direction of the housing (6).

6 Claims, 4 Drawing Sheets

1
2
3
4
5
6
7
8
9
10
11
12
13
14
15
18
Tolerance
min. installation position
max. installation position 1
2
3
4
5
6
7
8
9
10
11
12
16
17
18
max. installation position
min. installation position
Tolerance

ACTUATOR DEVICE FOR ADJUSTING A SLIDING CAM SYSTEM

FIELD OF THE INVENTION

An actuator device for a sliding cam system, having at least one sliding cam and having an engagement pin which projects out of a housing, wherein the housing can be fastened to a component of a cylinder head or to the cylinder head of an internal combustion engine, and the engagement pin can be placed in contact with at least one groove of the sliding cam system, which groove has at least one ejection ramp, and wherein the engagement pin has, within the housing, a permanent holding magnet and, adjoining the latter, is a controlling stationary coil core which can be magnetized by an electrical coil, and the engagement pin is spring-loaded in the direction of the sliding cam.

BACKGROUND

A generic actuator of said type is known from DE-102 40 774 A1. Proceeding from the retracted, inner position of the engagement pin, an activation of the engagement pin is realized through energization of the coil, as a result of which a magnetic field is generated which opposes the field of the permanent holding magnet and displaces the latter. The displacement of the field results in a reduced holding force between the permanent holding magnet and the coil core, such that the magnetic field generated by the coil and the force of the spring acting on the engagement pin causes a deployment of the engagement pin, such that the latter engages into the groove of the sliding cam and, as desired, effects a displacement of the sliding cam.

The return movement of the engagement pin into its inner end position is initiated by the ejection ramp, the aim of which is to move the engagement pin away from the sliding cam counter to the force of the spring to such an extent, and with such an acceleration, that the engagement pin, when the coil is deenergized, is held fixed by the permanent holding magnet and the magnetic field thereof on the coil core.

A problem of this generic design is that, depending on the tolerances of the actuator radially with respect to the sliding cam, the movement and acceleration of the engagement pin by the ejection ramp is not sufficient to ensure that the engagement pin reaches the inner position and is stabilized counter to the force of the spring by the permanent holding magnet.

Furthermore, there is the problem that, in the case of sliding cam systems with three or more sliding cams, at least two engagement pins must be provided. Here, a small spacing of the engagement pins is demanded, said spacing being predefined by the spacing of the gas exchange valves, the spacing of the cylinders of the internal combustion engine and the number of sliding cams. As a result of the small spacing, the design of the actuator described in the prior art is no longer capable of moving and holding the engagement pin with sufficient speed and force.

SUMMARY

It is therefore an object of the invention to improve an actuator having features described in the introduction in such a way that greater tolerances can be accommodated, and also a desired small spacing of the engagement pins to one another can be ensured.

The object of the invention is achieved in that, at least at that end region of the engagement pin which faces toward the sliding cam, there is installed an actuating device which is active in the region in which the ejection ramp runs out at the high circle, which actuating device generates an auxiliary force on the engagement pin in the direction of the housing.

The actuating device generates, in addition to the force introduced by the ejection ramp, an auxiliary force by means of which the engagement pin reliably reaches the inner end position. As a result, the tolerances arising during the installation of the electrically actuable device have no significant influence on the actuation of the engagement pin, such that the tolerances need not be kept particularly small. Furthermore, the dimensions of the parts installed in the housing, in particular of the permanent holding magnet on the engagement pin, can be kept smaller, such that it is also possible to realize a smaller spacing of the engagement pins to one another.

In one advantageous embodiment of the invention, it is provided that the engagement pin has, on its end facing toward the sliding cam, an opening in which there is displaceably arranged an actuating element which is loaded in the direction of the sliding cam by means of a restoring spring. Here, the position and the travel of the actuating element and the force of the spring are dimensioned such that the actuating element is compressed in particular in the region of the ejection ramp, but lengthens and is supported against the ejection ramp at the end of the latter, as a result of which the restoring spring of the actuating element exerts such a force on the engagement pin that the latter overcomes the remaining stroke and passes reliably into its inner end position.

In a further embodiment of the invention, it is provided that the actuating element on the engagement pin is in the form of a ball which is installed in a bore of the engagement pin with the associated spring, and that the bore has a constriction at its end in order to ensure that the ball is securely held so as to be prevented from falling out. The constriction may be realized by means of calking of the edge of the bore.

In an alternative embodiment of the invention, it is proposed that the engagement pin has, on its end facing toward the sliding cam, and the throw-off ramp has, in the region in which it runs out at the high circle, respectively one permanent magnet and one permanent counter-magnet, and in that said permanent magnets are installed with opposite poles directed toward one another.

By means of said embodiment of the invention, it is achieved that the repelling magnetic forces of the permanent magnet and of the permanent counter-magnet generate, in the end region of the throw-off ramp, such a force that the engagement pin overcomes the remaining stroke generated inter alia in the case of unfavourable tolerances, and reliably moves into its end position.

It is furthermore expedient for the permanent holding magnet on the engagement pin within the housing to be surrounded by a holding cap or a holding plate which is fastened to the engagement pin in order to securely fix the permanent holding magnet to the engagement pin.

BRIEF DESCRIPTION OF THE DRAWINGS

For further explanation of the invention, reference is made to the drawings, which illustrate exemplary embodiments of the invention in simplified form and in which.

DETAILED DESCRIPTION OF THE PREFERRED EMBODIMENTS

Figure 1:
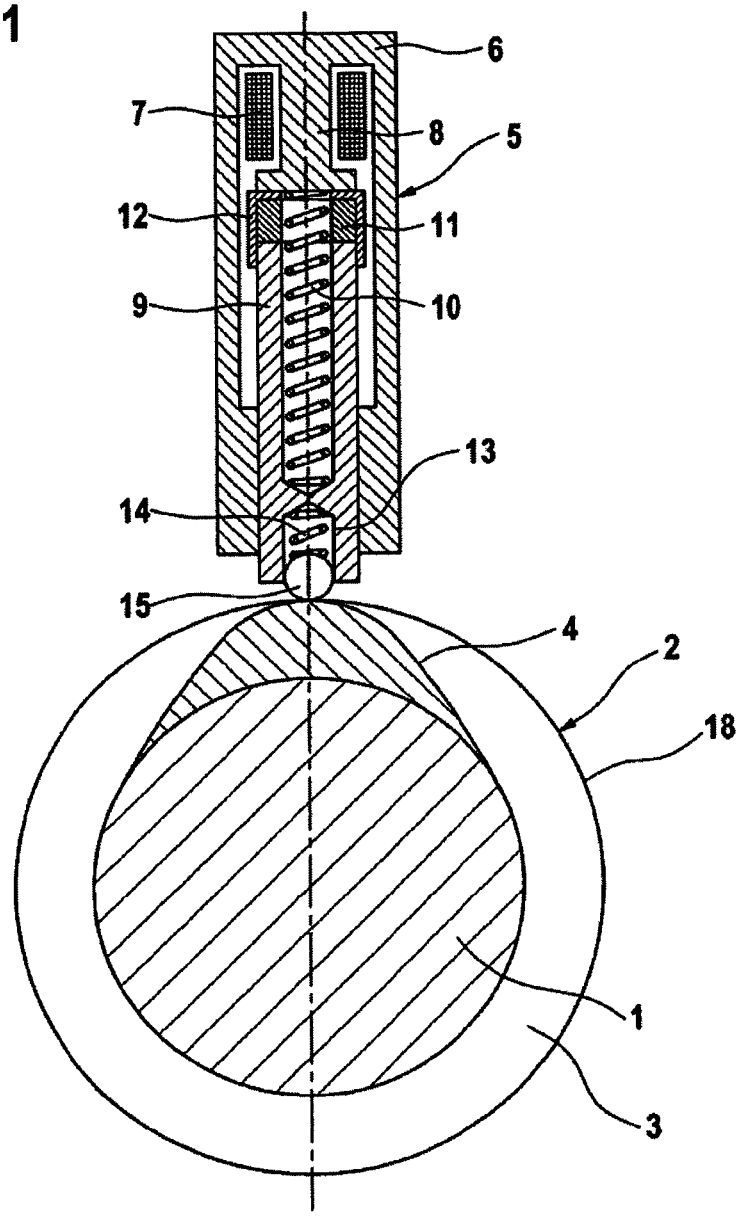
FIG. 1: shows a section through a sliding cam and an associated actuator.

FIGS. 1 to 7 show, where illustrated in detail, a camshaft, denoted by 1, of a reciprocating-piston internal combustion engine, on which camshaft a sliding cam 2 is arranged in a rotationally conjoint but displaceable manner, which sliding cam has, adjacent to the cams for the gas exchange valves, at least one groove 3 which comprises a ejection ramp 4. The ejection ramp 4 extends up to a high circle, denoted by 18, of the sliding cam 2 in the region of the groove 3. Provided so as to be compatible with the groove 3 is an actuator which is denoted generally by 5 and which has a housing 6, a coil 7 with a coil core 8 and an engagement pin 9. The engagement pin 9 is arranged within the housing 6 so as to be radially movable relative to the groove 3 and has, in the interior, a spring 10 which preloads the engagement pin 9 in the direction of the sliding cam 2. Adjacent to the coil core 8, there is fastened to the engagement pin 9 a permanent holding magnet 11, the magnetic force of which is greater than the force of the spring 10 which is supported at its inner end on the coil core 8. The permanent holding magnet 11 is surrounded by a holding cap 12 which fixes said permanent holding magnet to the engagement pin 9. The engagement pin 9 furthermore has, at its end facing toward the sliding cam 2, a bore 13 in which a restoring spring 14 is installed, which restoring spring loads a ball 15 in the direction of the sliding cam 2.

Here, the ball 15 protrudes so far that, at least in the region of the ejection ramp 4, said ball is pushed into the bore 13 counter to the force of the restoring spring 14 such that the restoring spring stores force, and the restoring spring, at the end of the ejection ramp, relaxes and accelerates the engagement pin 9 with such intensity that the latter reliably passes into the inner end position.

Figures 2, 3:
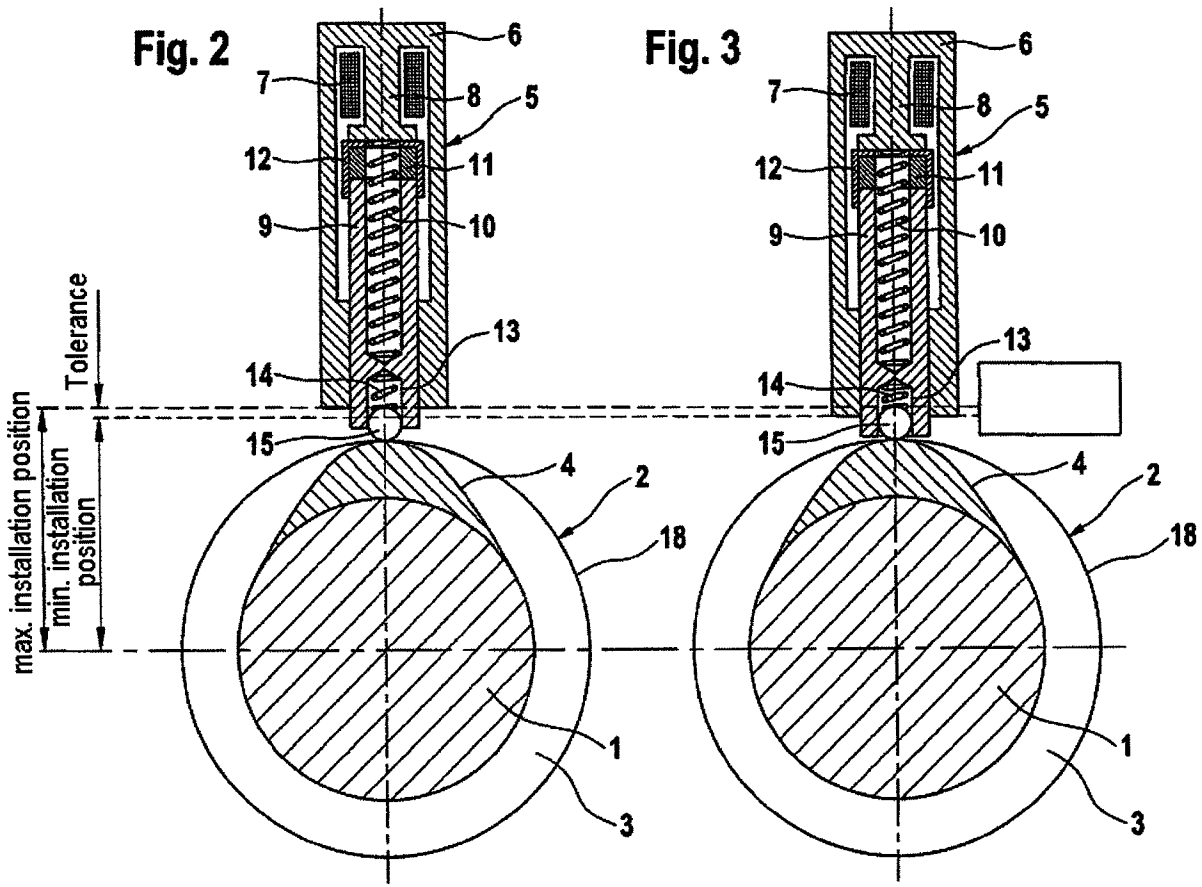
FIGS. 2 and 3: show sections corresponding to FIG. 1, in which different installation tolerances are illustrated.

As a result, as can be seen from FIGS. 2 and 3, even relatively large tolerances are overcome.

Figures 4, 5:
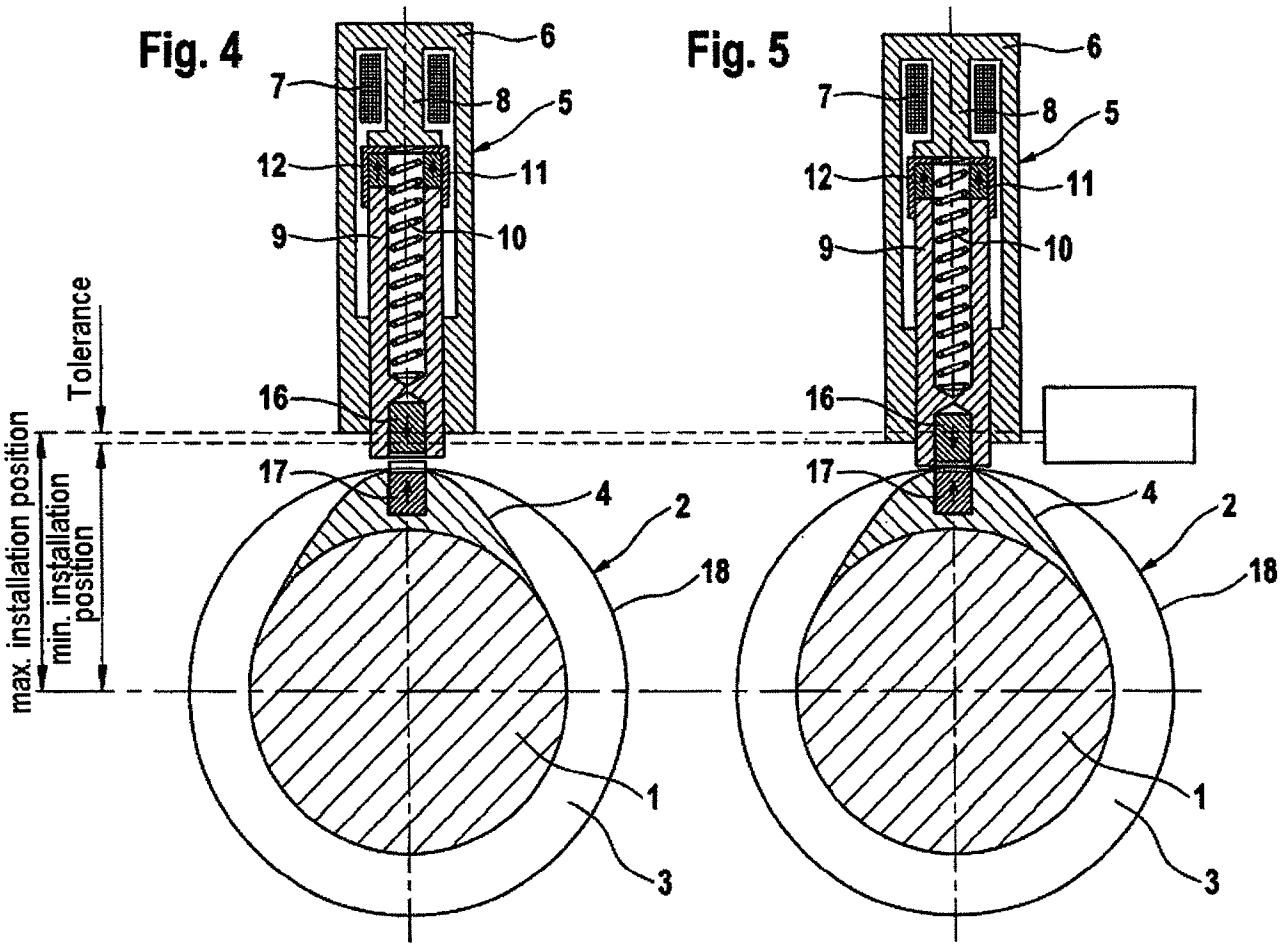
FIGS. 4 and 5: show sections with different tolerances, corresponding to FIGS. 2 and 3, in a modified embodiment of the invention.

In the exemplary embodiments of FIGS. 4 and 5, permanent magnets 16 are installed on those ends of the engagement pins 9 which face toward the sliding cam 2. Furthermore, the sliding cams 2 have permanent counter-magnets 17 in the region of the end of the ejection ramp 4, the magnetic forces of which permanent counter-magnets are oriented in the opposite direction, as can be seen from the arrows. Now, when the ends of the engagement pins 9 and thus the permanent magnets 16 pass into the region of the permanent counter-magnet 17 during the rotation of the camshaft 1 and thus of the sliding cam 2, the engagement pin 9 is subjected to a force and thus an acceleration away from the sliding cam 2, such that correspondingly to the embodiment according to FIGS. 2 and 3, the permanent magnet 11 passes reliably to the coil core 8.

As can furthermore be seen from FIGS. 4 and 5, relatively great tolerances are overcome here, too.

Figure 7:
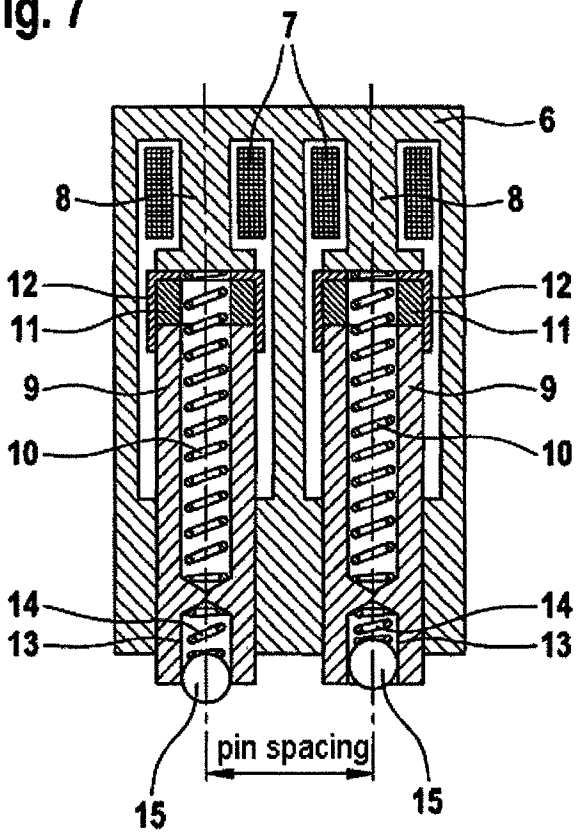
FIGS. 6 and 7: show sections through actuators which have been combined to form a structural unit, with the engagement pins being situated closely adjacent to one another.
Figure 6:
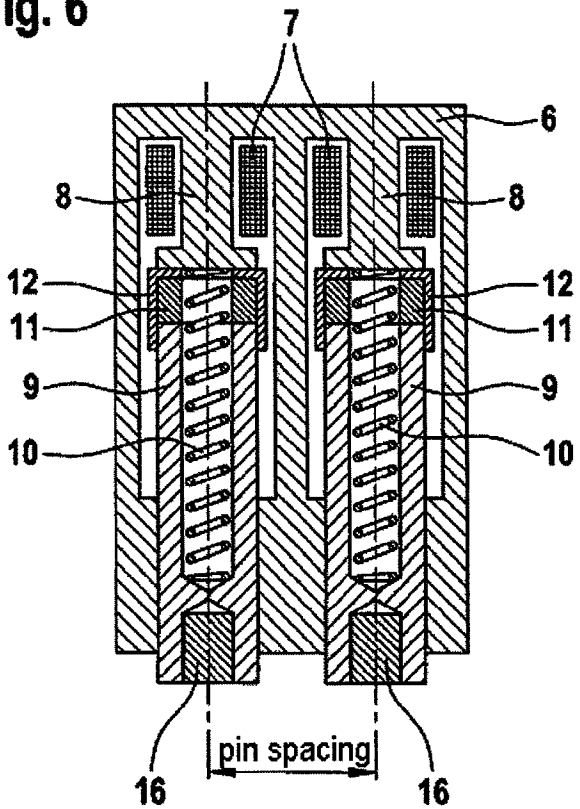

In FIGS. 6 and 7, the housing 6 is expanded such that in each case two engagement pins 9 can be installed closely adjacent to one another, and even a spacing of only 5 mm can be attained.

The ends of the engagement pins 9 are designed correspondingly to the embodiments of the invention described above and are equipped with permanent magnets 16 or balls 15.

LIST OF REFERENCE NUMERALS

1 Camshaft
2 Sliding cam
3 Groove
4 Ejection ramp
5 Actuator
6 Housing
7 Coil
8 Coil core
9 Engagement pin
10 Spring
11 Permanent holding magnet
12 Holding cap
13 Bore
14 Restoring spring
15 Ball
16 Permanent magnet
17 Permanent counter-magnet
18 High circle

The invention claimed is:

1. An actuator device for a sliding cam system, comprising at least one sliding cam and an engagement pin which projects out of a housing, the housing is fastenable to a component of a cylinder head or to the cylinder head of an internal combustion engine, and the engagement pin is movable into contact with at least one groove of the sliding cam system, said groove has at least one ejection ramp, and wherein the engagement pin has, within the housing, a permanent holding magnet and, adjoining the permanent holding magnet, is a controlling stationary coil core which is magnetizable by an electrical coil, and the engagement pin is spring-loaded in a direction of the sliding cam, at least at an end region of the engagement pin which faces toward the sliding cam, there is an actuating device which is active in a region in which the ejection ramp runs out at a high circle, said actuating device generates an auxiliary force on the engagement pin in a direction of the housing.

2. The actuator device as claimed in claim 1, wherein the actuating device comprises, on the end of the engagement pin which faces toward the sliding cam, an opening in which there is displaceably arranged an actuating element which is loaded in a direction of the sliding cam by a restoring spring.

3. The actuator device as claimed in claim 2, wherein the actuating element is a ball which is arranged in a bore and a movement of which in the direction of the sliding cam is limited by a constriction at an end of the bore.

4. The actuator device as claimed in claim 1, wherein the permanent holding magnet on the engagement pin is surrounded by a holding cap which is fastened to the engagement pin.

5. The actuator device as claimed in claim 1, wherein the sliding cam system has three or more cams and a corresponding number of grooves, and at least two of the actuators are arranged adjacent to one another within one of the housings.

6. An actuator device for a sliding cam system, comprising at least one sliding cam and an engagement pin which projects out of a housing, the housing is fastenable to a component of a cylinder head or to the cylinder head of an internal combustion engine, and the engagement pin is movable into contact with at least one groove of the sliding cam system, said groove has at least one ejection ramp, and wherein the engagement pin has, within the housing, a permanent holding magnet and, adjoining the permanent holding magnet, is a controlling stationary coil core which is magnetizable by an electrical coil, and the engagement pin is spring-loaded in a direction of the sliding cam, at least at an end region of the engagement pin which faces toward the sliding cam, there is an actuating device which is active in a region in which the ejection ramp runs out at a high circle, said actuating device generates an auxiliary force on the engagement pin in a direction of the housing, the actuating device having, at the end of the engagement pin which faces toward the sliding cam and in the region in which the ejection ramp runs out at the high circle, respectively, one permanent magnet and a permanent counter-magnet, and said one permanent magnet and said permanent counter-magnet are installed with opposite poles directed toward one another.

* * * * *